United States Patent [19]

Graf et al.

[11] Patent Number: 4,549,934

[45] Date of Patent: Oct. 29, 1985

[54] FLASH ZONE DRAW TRAY FOR COKER FRACTIONATOR

[75] Inventors: Harlan G. Graf; Harry R. Janssen; George A. Kurdy, all of Ponca City, Okla.

[73] Assignee: Conoco, Inc., Ponca City, Okla.

[21] Appl. No.: 603,869

[22] Filed: Apr. 25, 1984

[51] Int. Cl.[4] ..... C10G 7/00

[52] U.S. Cl. ..... 196/98; 196/102; 196/133; 196/140; 208/106; 208/131

[58] Field of Search ..... 196/98, 100, 102, 133, 196/140; 208/131, 106, 48 R, 358, 350; 201/28

[56] References Cited

U.S. PATENT DOCUMENTS

| | | | |
|---|---|---|---|
| 2,126,204 | 8/1938 | Morrell | 196/98 |
| 3,379,638 | 4/1968 | Bloomer et al. | 208/8 R |
| 3,563,884 | 7/1968 | Bloomer et al. | 208/81 |
| 3,687,840 | 8/1972 | Sze et al. | 208/131 |
| 4,036,736 | 7/1977 | Ozaki et al. | 208/106 |
| 4,108,798 | 8/1978 | Sze et al. | 208/131 |
| 4,216,074 | 8/1980 | Simone | 208/131 |

OTHER PUBLICATIONS

"Delayed Coking," *The Oil and Gas Journal,* Jan. 2, 1956, pp. 89–90, by Kash et al.

*Primary Examiner*—Jay H. Woo
*Assistant Examiner*—Mike McGurk
*Attorney, Agent, or Firm*—Richard W. Collins

[57] ABSTRACT

An internal draw tray is added to the flash zone of a coker fractionator below the coker vapor inlet to collect condensed coke drum overhead components and to keep the condensed material separate from the fresh feed to the coker furnace.

7 Claims, 1 Drawing Figure

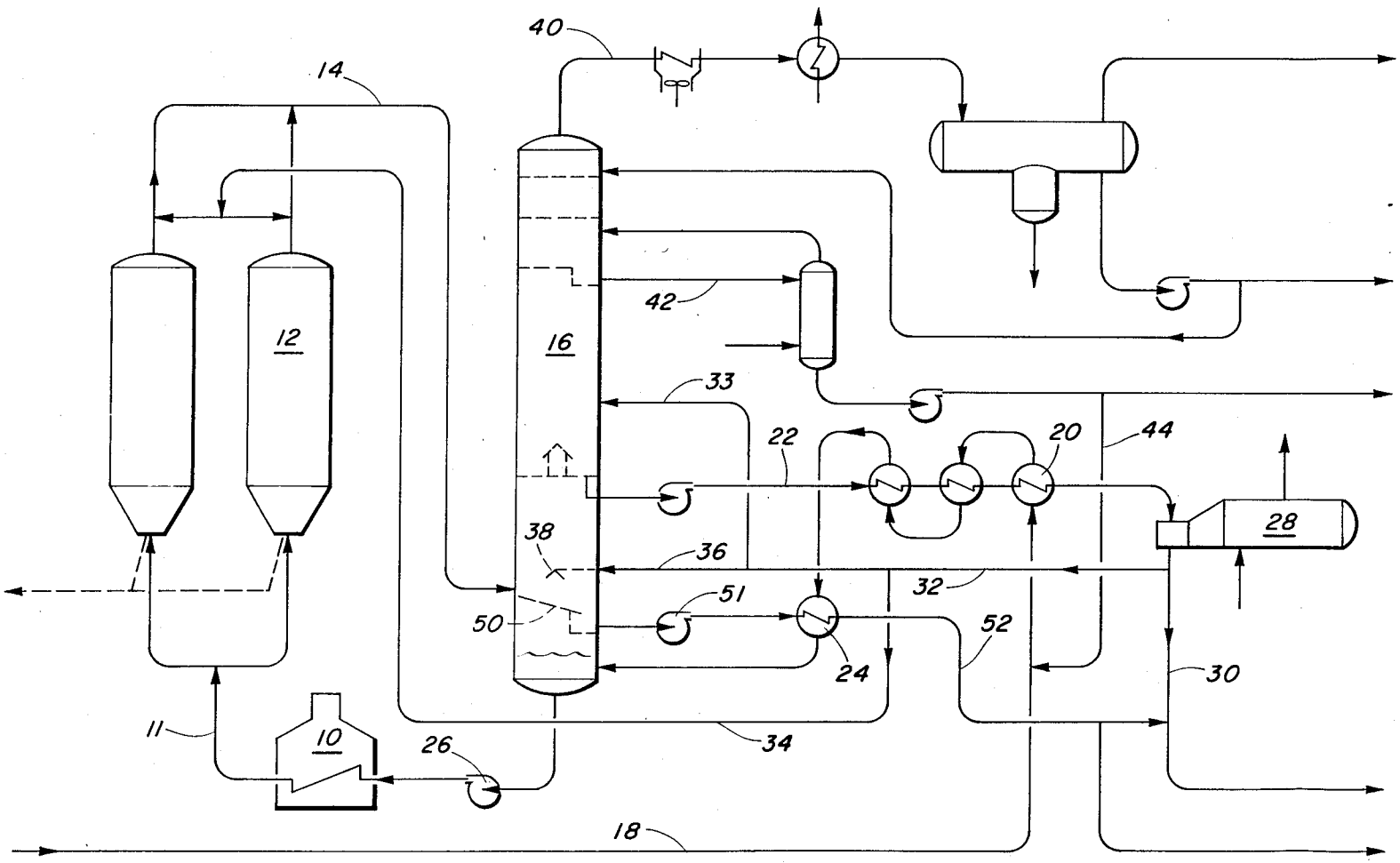
28
30
44
20
52
32
24
22
34
33
36
51
42
18
40
16
38
50
26
14
12
10
11

FLASH ZONE DRAW TRAY FOR COKER FRACTIONATOR

BACKGROUND OF THE INVENTION

1. Field of the Invention

This invention relates to delayed coking of heavy hydrocarbons, and more particularly to improved apparatus for improving the product yield structure from a delayed coking unit.

Delayed coking has been practiced for many years. The process broadly involves thermal decomposition of heavy liquid hydrocarbons to produce gas, liquid streams of various boiling ranges, and coke.

Coking of resids from heavy, sour (high sulfur) crude oils is carried out primarily as a means of disposing of low value resids by converting part of the resids to more valuable liquid and gas products. The resulting coke is generally treated as a low value by-product.

In the production of fuel grade delayed coke, and even to some extent in the production of anode or aluminum grade delayed coke, it is desirable to minimize the coke yield, and to maximize the liquids yield, as the liquids are more valuable than the coke.

The use of heavy crude oils having high metals and sulfur content is increasing in many refineries, and delayed coking operations are of increasing importance to refiners. The increasing concern for minimizing air pollution is a further incentive for treating resids in a delayed coker, as the coker produces gases and liquids having sulfur in a form that can be relatively easily removed.

In delayed coking process for making fuel grade coke or aluminum or anode grade coke, the coke is generally the least valuable product, and it is desired to improve the product yield structure by minimizing or decreasing the coke yield while increasing the yield of the more valuable liquid products.

2. The Prior Art

In the basic delayed coking process as practiced today, fresh feedstock is introduced into the lower part of a coker fractionator and the fractionator bottoms including heavy recycle material and fresh feedstock are heated to coking temperature in a coker furnace. The hot feed then goes to a coke drum maintained at coking conditions of temperature and pressure where the feed decomposes or cracks to form coke and volatile components. The volatile components are removed as coke drum vapor and returned to the fractionator. The heaviest components of the coke drum vapors are condensed by one of several methods, including direct or indirect heat exchange. Typically, heavy coker gas oil from the coker fractionator is cooled by heat exchange with fresh feed and then returned to the fractionator where it is sprayed into the fractionator flash zone to contact incoming vapors and condense the heavier components thereof. The heaviest components of the coke drum vapors could be condensed by other techniques, such as indirect heat exchange, but in commercial operations it is common to contact the incoming vapors with a heavy coker gas oil in the coker fractionator.

The delayed coking process is described in more detail by Kash et al entitled "Delayed Coking," *The Oil and Gas Journal,* Jan. 2, 1956, pp 89–90.

A delayed coking process for coal tar pitches illustrating use of heavy recycle is shown in U.S. Pat. No. 3,563,884 to Bloomer et al.

A delayed coking process for coal extract using a separate surge tank for the feed to the coker furnace is shown in U.S. Pat. No. 3,379,638 to Bloomer et al.

A process for producing a soft synthetic coal having a volatile matter content of more than 20 percent by weight is described in U.S. Pat. No. 4,036,736 to Ozaki et al. In that reference, a diluent gas is added to th coke drum to maintain a reduced partial pressure of cracked hydrocarbons, or the process is carried out under less than atmospheric pressure.

In commonly assigned co-pending Application Ser. No. 590,607 now U.S. Pat. No. 4,518,487 filed Mar. 19, 1984 by Harlan G. Graf et al for "Process for Improving Product Yields from Delayed Coking", a delayed coking process is described in which condensed coke drum vapors are removed from the process rather than being utilized as recycle. This results in a decreased coke yield and increased liquids yields. The present invention is directed to improved apparatus for carrying out such a process.

SUMMARY OF THE INVENTION

According to the present invention, a coker fractionator is provided with an internal draw tray adapted to collect condensed heavy components from the coke drum vapor stream and to keep these components separate from fresh coker feed. In a preferred embodiment, means are provided for combining a hydrocarbon distillate, which is lighter than conventional coker recycle, with fresh feed to the process as recycle.

THE DRAWINGS

The FIGURE is a schematic representation of a delayed coking unit having an internal draw tray in the bottom of the flash zone of the fractionator in accordance with the invention.

DESCRIPTION OF THE PREFERRED EMBODIMENTS

In the design and operation of a delayed coker, the furnace is the most critical piece of equipment. The furnace must be able to heat the feedstock to coking temperatures without causing coke formation on the furnace tubes. When the furnace tubes become coked, the operation must be shut down and the furnace cleaned out. Conventional fuel grade or aluminum grade delayed coking processes require that an amount of recycle material be combined with the fresh feed before it is fed to the furnace. The recycle material improves the furance operation, and provides a solvent effect which aids in preventing coke formation on the furnace tubes. Conventional coker recycle material is comprised largely of the condensed heavier components of the coke drum vapors. This material is generated by cooling incoming vapors in the flash zone of a coker fractionator. These incoming coke drum vapors may be directly cooled by contact with cooler liquid hydrocarbons, either by spraying, baffles, contact trays or the like, or indirectly by a heat exchanger.

The use of condensed heavy components of coke drum vapor as recycle inherently leads to coke yields that are higher than would be obtained if this material were not used as recycle. This invention provides a means for assuring that the condensed heavier components of the coke drum vapor are not combined with the fresh feed to the process, thereby providing a lower coke yield, based on fresh feed to the process, than would be obtained if these condensed components were combined with the fresh feed as recycle.

The present invention enables the operation of a delayed coking unit without the necessity of using heavy condensed material as recycle. In cases where recycle is necessary to provide good furnace operation, lighter hydrocarbon material, such as distillate taken from the coker fractionator above the heavy gas oil draw tray, can be combined with fresh feed and fed to the coker furnace without any addition of conventional heavy recycle material.

Referring now to the FIGURE, a delayed coking unit is shown. The coking unit includes coker furnace 10, coker transfer line 11, a pair of coking drums 12 which are alternately filled and emptied in a conventional manner, and coke drum vapor line 14 extending from the tops of drums 12 to coker fractionator 16. Fresh feed to the unit is provided through fresh feed line 18, and heat exchangers 20 provide feed preheat by heat exchange with heavy gas oil from line 22. Additional feed preheat is provided in heat exchanger 24. Preheated feed then passes to the bottom of fractionator 16 which provides surge capacity for furnace feed pump 26. Heavy gas oil from line 22 passes to waste heat boiler 28 and part of the heavy gas oil is withdrawn through product line 30 and part of it is returned via lines 32 and 33 as reflux. Another part of the heavy gas oil from line 32 is routed via line 34 as vapor line quench oil. Still another part of the heavy gas oil is routed through line 36 to spray nozzles 38 located in the flash zone of fractionator 16 above the vapor inlet level.

Gases and light ends from fractionator 16 are taken off through line 40 and processed in a conventional manner. A distillate stream lighter than heavy coker gas oil is recovered through line 42, and a portion of this distillate stream may be routed through line 44 to combine with fresh feed in line 18.

The essential element of the present invention is in the provision of internal draw tray 50 in fractionator 16 below the vapor inlet. Material collected on draw tray 50 is removed from the unit via pump 51 and line 52.

OPERATION

The opertion of a coking unit including an internal draw tray below the flash zone of the fractionator will now be described.

Fresh feed in line 18 is combined with sufficient distillate hydrocarbon from line 44 to provide a furnace charge which will enable coker furnace 10 to operate without excessive furnace tube coking. The furnace charge is heated to coking temperature in furnace 10 and then passed via transfer line 11 to coking drum 12 where solid delayed coke and cracked hydrocarbons are formed. Vapors from drum 12, comprising both cracked and vaporized materials, pass through line 14 to fractionator 16 after being quenched by quench oil from line 34 to prevent deposits of coke in vapor line 14. Quenched vapor from line 14 enters the lower portion of fractionator 16 above draw tray 50. The incoming vapors are cooled in fractionator 16 by any suitable means. As shown in the FIGURE, the vapors are contacted with heavy gas oil from spray nozzles 38 to condense the heavier components from the incoming vapor stream. Most of the heavy gas oil is vaporized by contact with hot incoming vapors, but the heaviest components of the gas oil may remain unvaporized. These condensed vapor components and any unflashed heavy gas oil fall to internal draw tray 50 and are removed from the unit via pump 51 and line 52.

In the conventional operation of a coking unit wihout the internal draw tray of this invention, the condensed portion of the coke drum vapors and unvaporized heavy gas oil would fall to the bottom of fractionator 16 and combine with fresh feed in the bottom thereof. These materials contribute to the ultimate coke yield and result in a higher coke yield than is obtained when they are removed from the unit.

It will be appreciated that the heavy components from incoming coke drum vapors may be condensed by means other than the spray nozzles illustrated in the FIGURE. A series of baffles, vapor-liquid contact trays or indirect heat exchange means could be substituted for the spray nozzles. Also, the manner of handling the products from fractionator 16 could be modified in many respects without affecting the essential element of the invention which is the provision of an internal draw tray for collecting condensed vapor components and means for removing the condensed material from the coking unit.

To illustrate the coke yield potential from combining conventional heavy recycle with fresh coker feedstock, the contributions to coke yield from various fractions of heavy coker gas oil were determined. Several boiling range fractions of heavy coker gas oil were coked individually, and the weight percent coke yield as well as the amount of each fraction was determined. The results are shown below:

TABLE 1

CONTRIBUTIONS OF EACH FRACTION TO THE WHOLE FEEDSTOCK COKE YIELD

| Heavy Coker Gas Oil Fraction | (A) Fraction of Entire Feed Wt Basis | (B) Coke Yield Wt % | A × B, Wt % | Fractional Contribution to Entire Gas Oil Coke Yield |
|---|---|---|---|---|
| −550° F. | 0.014 | 0.0 | 0.00 | 0.0 |
| 550–650° F. | 0.103 | 1.3 | 0.13 | 0.8 |
| 650–750° F. | 0.221 | 4.5 | 0.99 | 6.3 |
| 750–850° F. | 0.335 | 12.8 | 4.28 | 27.5 |
| 850+° F. | 0.327 | 31.3 | 10.2 | 65.4 |
| Sum | | | 15.6 | 100.0 |

As seen in Table 1, the potential coke yield from heavy coke gas oil is significant. It is also apparent that the bulk of the coke from the heavy gas oil comes from the highest boiling fraction. It is thus especially important to eliminate the heaviest condensible material in the coke drum vapors and the heaviest material in the heavy coker gas oil from the feed to the coker furnace. By substituting a lighter distillate hydrocarbon material for the heavy recycle normally used, the coke yield as a percent of fresh feed is significantly reduced, and the more desirable liquid product yield is increased.

EXAMPLE

The improved product yield structure provided by this invention is demonstrated in the following simulated example derived from a highly developed coker design program. In this example, two runs were made using identical feedstocks and coking conditions, except in one case conventional heavy coker recycle (20 parts by volume for each 100 parts by volume fresh feed) was used for the recycle, and in the other case a hydrocarbon distillate material having a boiling range of from 510° to 650° F. (20 parts by volume for each 100 parts by volume fresh feed) was used for the recycle.

In both runs, a 1000° F.+ Bachaquero vacuum resid having an API gravity of 4.3, a Conradson carbon value of 23.5 weight percent, a UOP characterization factor "K" of 11.5 and a sulfur content of 3.5 weight percent was coked at a coke drum pressure of 20 psig and a coke drum top temperature of 835° F. The product distribution for the two runs is tabulated below:

| YIELDS - WEIGHT PERCENT | | |
|---|---|---|
| Component | Conventional Heavy Recycle | Distillate Recycle |
| $H_2S$ | 1.00 | 1.00 |
| Hydrogen | 0.09 | 0.09 |
| Methane | 3.65 | 3.53 |
| Total $C_2$ | 1.32 | 1.16 |
| Total $C_3$ | 1.58 | 1.32 |
| Total $C_4$ | 1.71 | 1.54 |
| Liquids ($C_5$+) | 55.99 | 58.84 |
| Green Coke | 34.66 | 32.53 |

As seen in the above Table, a reduction in coke yield of over 6 percent (34.66 versus 32.53) is obtained when a distillate hydrocarbon having a boiling range of 510° to 650° F. is used as recycle in place of conventional heavy coker recycle. A corresponding increase of almost 5 percent in $C_5$+liquids is obtained (58.84 versus 55.99). Similar decreases in coke yield and increases in liquids yield are obtained with different feedstocks at the same or different coking conditions.

The foregoing description of the preferred embodiments of the invention is intended to be illustrative rather than limiting of the invention, which is defined by the appended claims.

We claim:

1. In a delayed coking unit comprising a coker furnace, at least two coking drums, fresh feed line means, coker transfer line means extending from said furnace to said drums, a coker fractionator, vapor line means extending from said drums to said fractionator, and means in said fractionator for condensing the heavier components of vapor entering said fractionator from said vapor line means, the improvement comprising:

(a) an internal draw tray (50) in said coker fractionator, said tray being below the vapor line means inlet to said coker fractionator and below said means for condensing the heavier components of vapor and being adapted to collect said condensed vapor components, and (b) means for removing from said coker fractionator and said coking unit said condensed vapor components collected on said internal draw tray.

2. A delayed coking unit in accordance with claim 1 wherein the fresh feed line means is provided for feeding fresh feed to the bottom of said fractionator below said internal draw tray and for transferring fresh feed from the bottom of said fractionator to said coker furnace.

3. A delayed coking unit in accordance with claim 1 wherein said means for condensing the heavier components of vapor comprises means for contacting said vapor with liquid hydrocarbons.

4. A delayed coking unit in accordance with claim 1 wherein said means for condensing the heavier components of vapor comprises indirect heat exchange means.

5. A delayed coking unit in accordance with claim 1 wherein said means for condensing the heavier components of vapor comprises spray nozzles adapted to spray liquid hydrocarbons into said fractionator in contact with said vapor.

6. A delayed coking unit in accordance with claim 5 including a heavy coker gas oil draw tray in said fractionator above said internal draw tray (50) and above said spray nozzles, a heavy coker gas oil line for removing heavy coker gas oil from said heavy coker gas oil draw tray, heat exchanger means for cooling heavy coker gas oil in said heavy coker gas oil line, and a heavy coker gas oil return line for returning cooled heavy coker gas oil to said spray nozzles.

7. A delayed coking unit in accordance with claim 6 including a distillate line for adding distillate which is lighter than heavy coker gas oil to said fresh feed line means as recycle to said coker furnace.

* * * * *